US007656301B2

(12) United States Patent
Wang

(10) Patent No.: US 7,656,301 B2
(45) Date of Patent: Feb. 2, 2010

(54) SMOKE DETECTION FOR HARDWARE CABINETS

(75) Inventor: David Gang Wang, San Diego, CA (US)

(73) Assignee: Teradata US, Inc., Miamisburg, OH (US)

( * ) Notice: Subject to any disclaimer, the term of this patent is extended or adjusted under 35 U.S.C. 154(b) by 347 days.

(21) Appl. No.: 11/300,623

(22) Filed: Dec. 14, 2005

(65) Prior Publication Data

US 2007/0132600 A1 Jun. 14, 2007

(51) Int. Cl.
*G08B 17/00* (2006.01)

(52) U.S. Cl. ..... 340/628; 340/629; 340/630

(58) Field of Classification Search ..... 340/628, 340/629, 630, 584, 693.6, 570; 73/863.1, 73/863.3, 863.51, 756; 429/13, 27; 454/184, 454/187

See application file for complete search history.

(56) References Cited

U.S. PATENT DOCUMENTS 4,615,224 A * 10/1986 Smith et al. ..... 73/863.33
5,103,212 A * 4/1992 Notarianni et al. ..... 340/628
5,137,026 A * 8/1992 Waterson et al. ..... 600/538
6,348,277 B1 * 2/2002 Faris et al. ..... 429/13
6,720,886 B2 * 4/2004 Seelbach et al. ..... 340/693.6

* cited by examiner

*Primary Examiner*—Van T. Trieu
(74) *Attorney, Agent, or Firm*—Steve McDonald

(57) ABSTRACT

An air-cooled electronic component cabinet has an air sampling conduit to enable smoke detection from air from different areas within the cabinet. An air sampling conduit has one or more orifices to sample air from the different areas within the cabinet, such as adjacent different electronic chassis assemblies or enclosures stacked in a rack within the cabinet. An axial fan or blower draws air samples into the conduit, or the air samples are drawn in by operation of convection or other airflow established within the cabinet. In the air sampling conduit, the air samples are mixed and conveyed for sampling by one or more smoke detection devices mounted, e.g., within the conduit, or within an attached expansion joint section to reduce the airflow velocity or accommodate multiple smoke detection devices. Orifices in the air sampling conduit varying in size or number at different conduit areas regulate associated sampled air proportions. A variety of configurations in which such air sampling conduits are deployed are presented.

20 Claims, 11 Drawing Sheets

SMOKE DETECTION FOR HARDWARE CABINETS

BACKGROUND

Fire and smoke detection in complex electronic equipment is made difficult when associated electronic components and devices are densely populated over an expansive area, such as in hardware cabinets frequently used in data centers or like environments. The cabinets typically contain a rack of air-cooled electronic hardware chassis enclosures with numerous components, where each enclosure is cooled by its own stream of coolant air.

A smoke or fire detection device positioned at one location in one chassis enclosure will not reliably detect smoke or fire in other chassis enclosures in the same cabinet, or even in other locations in the same chassis enclosure. Furthermore, retrofitting smoke or fire detection devices to existing equipment is made difficult by lack of free space in dense, complex configurations of the electronics. Undetected, smoke or fire could ruin the contents of affected hardware, and put lives and the entire data center facility at risk.

To completely cover all circuit boards in a typical rack of electronic chassis in an air-cooled cabinet with smoke or fire detecting sensors could require numerous sensors, possibly on the order of 30-60 sensors per electronic computer chassis. This would not only be difficult to physically accommodate in an already crowded chassis, but it could also be a challenge to monitor and analyze the sensor output of so many sensors, given the number of chassis in each cabinet and a large number of cabinets in a data center.

SUMMARY

An air-cooled electronic component cabinet has an air sampling conduit to enable smoke detection from air from different areas within the cabinet. An air sampling conduit has one or more orifices to sample air from the different areas within the cabinet, such as adjacent different electronic chassis assemblies or enclosures stacked in a rack within the cabinet. An axial fan or blower draws air samples into the conduit, or the air samples are drawn in by operation of convection or other airflow established within the cabinet. In the air sampling conduit, the air samples are mixed and conveyed for sampling by one or more smoke detection devices mounted, e.g., within the conduit, or within an attached expansion joint section to reduce the airflow velocity or accommodate multiple smoke detection devices. Orifices in the air sampling conduit varying in size or number at different conduit areas regulate associated sampled air proportions. A variety of configurations in which such air sampling conduits are deployed are possible.

Other features and advantages will become apparent from the description and claims that follow.

DETAILED DESCRIPTION

Figure 1:
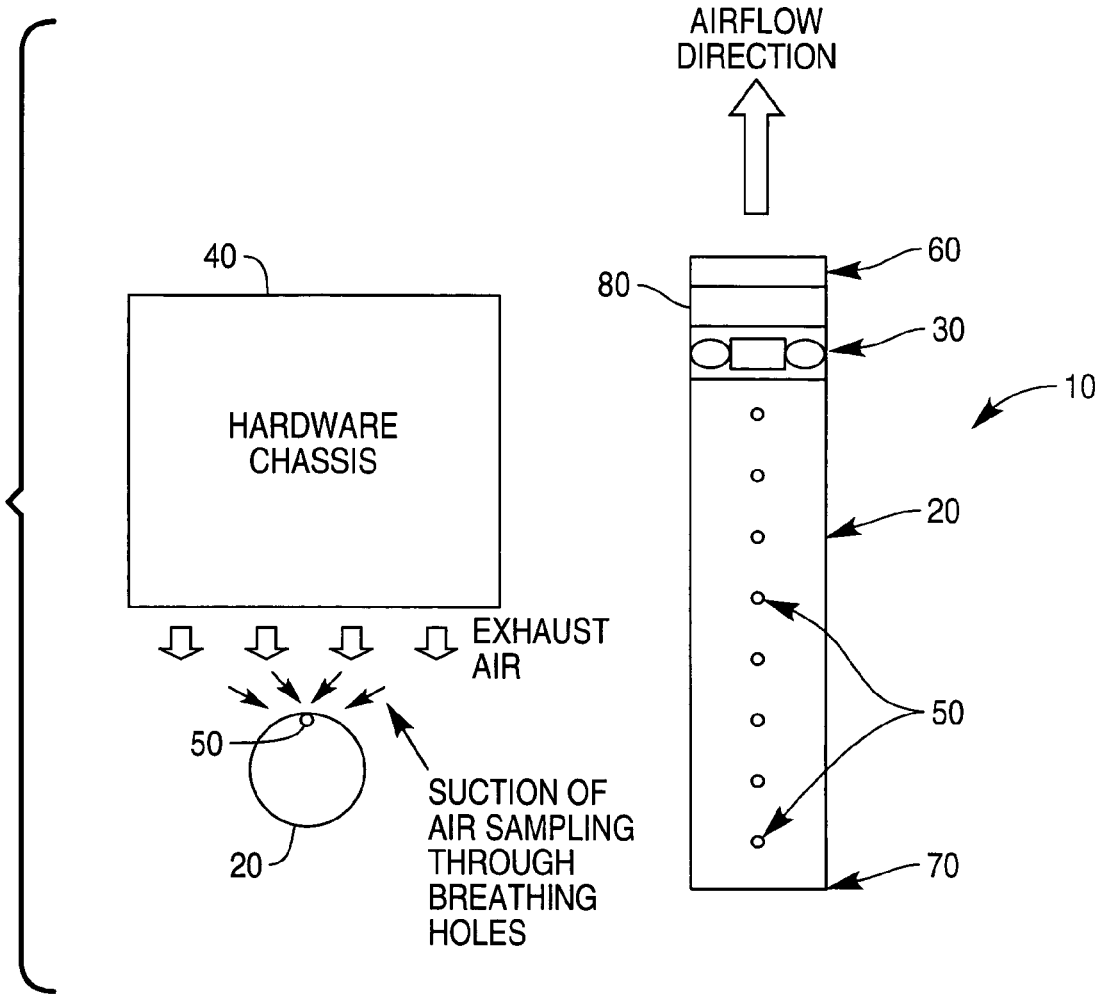
FIG. 1 shows smoke detection apparatus including an air sampling conduit assisted by an axial fan.

FIG. 1 illustrates a smoke detection apparatus 10 including an air sampling conduit 20 assisted by an axial fan 30. As shown, the air sampling conduit 20 is mounted by way of example at the back or exhaust side of an air cooled rack of electronic chassis 40 vertically stacked within a cabinet (not shown), as often found in high end computer room or telecommunications data centers. The air sampling conduit 20 has multiple, in this case a vertical row of, breathing holes or orifices 50 which are typically located to face the exhaust side of the chassis 40 for collection of exhaust air samples. The orifices 50 are shown located at each of different areas or elevation levels of the conduit 20, to sample air from the exhaust side of different electronic chassis assemblies 40 stacked vertically within the cabinet. Location, number and size of orifices 50 are selected to provide substantially equal sampled air mass flow rates through the orifices 50 and into air sampling conduit 20 at each of the different areas of the conduit 20. Location, number and size of orifices 50 are otherwise selected to control proportions of sampled air admitted through different areas of the conduit 20 as desired.

The smoke detection apparatus 10 shown in FIG. 1 further includes a smoke detection device 60 mounted within or in communication with airflow from conduit 20. For example the smoke detection device 60, e.g., which may comprise a commercially available unit, is mounted in conduit 20 upstream of axial fan 30 or downstream of axial fan 30 as shown. To facilitate flow of air samples in through orifices 50, the conduit 20 has a plugged lower end 70 opposite the device 60 or upper end 80 of the conduit 20. Detection of smoke traces by the device 60 is used to trigger appropriate power downs and alarms. To improve the performance of the apparatus 10, if needed, multiple smoke detection devices 60 are installed in communication with the air sampling conduit 20.

Figure 2:
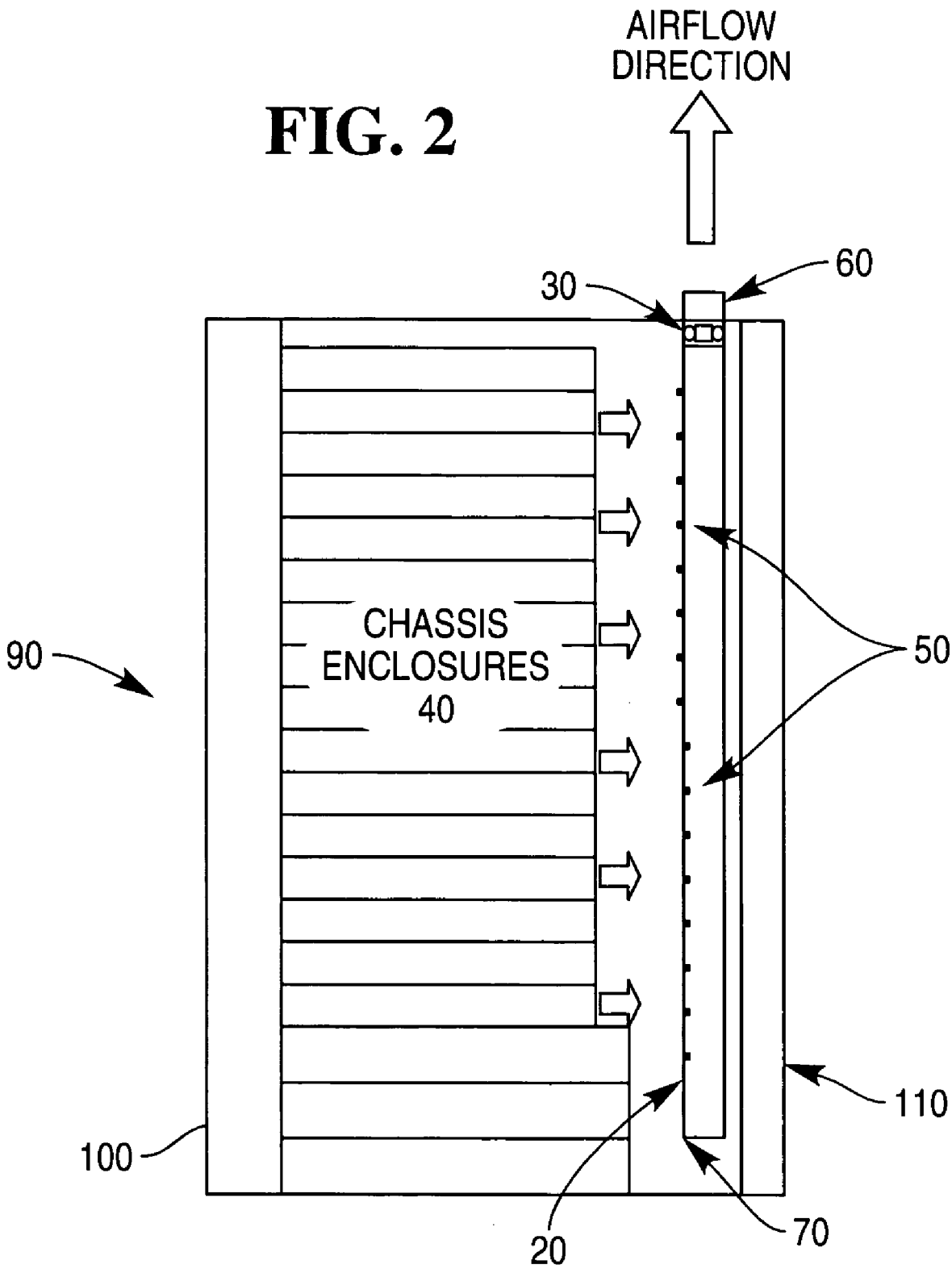
FIG. 2 shows the smoke detection apparatus of FIG. 1 used in an air cooled electronic chassis cabinet shown in side view.

FIG. 2 shows the smoke detection apparatus 10 of FIG. 1 used in an air cooled electronic chassis cabinet 90 shown in side view. The cabinet 90 has a front door 100 and a back door 110 used to service the rack of electronic chassis enclosures 40 vertically stacked inside the cabinet 90.

Figure 3:
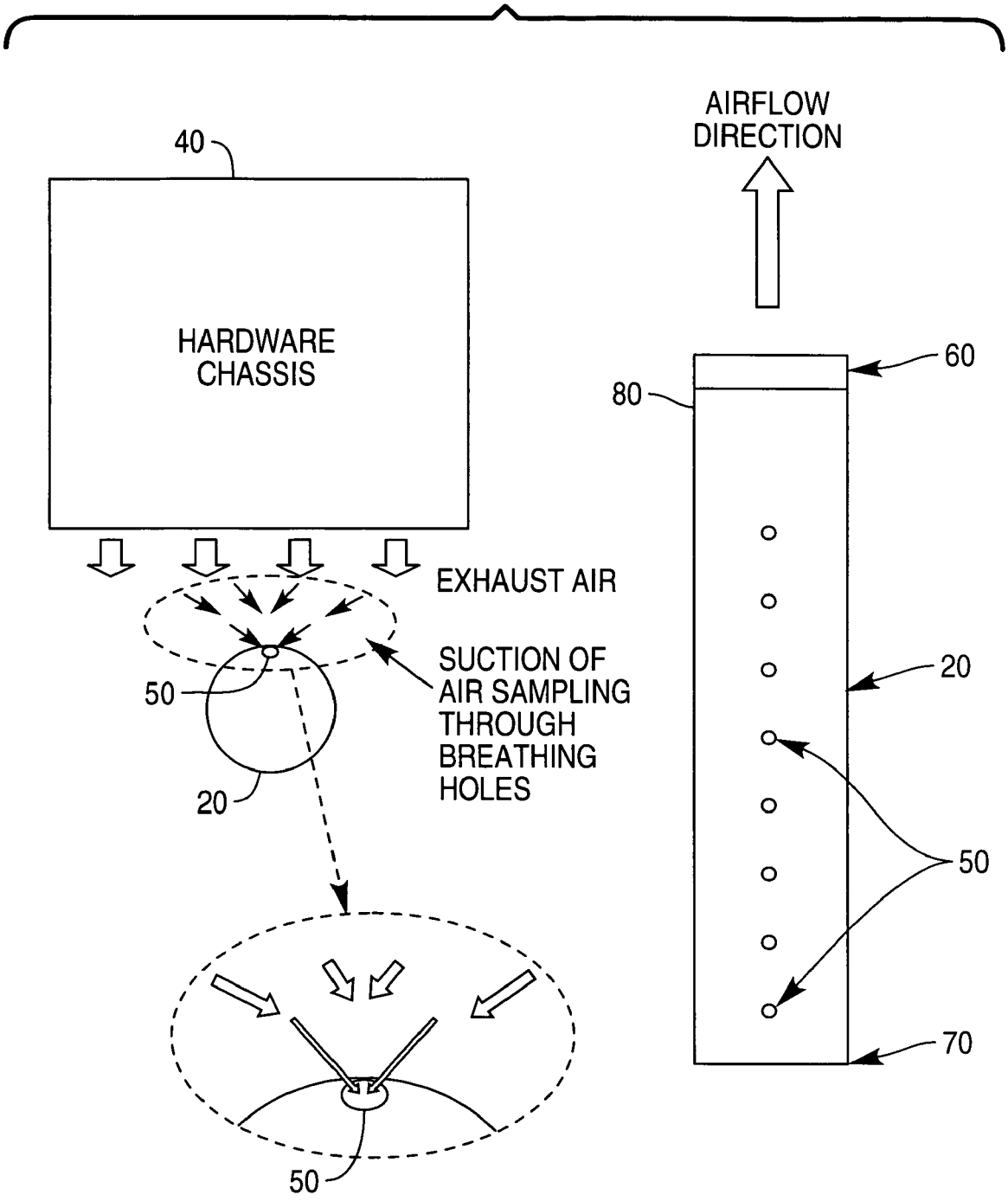
FIG. 3 shows smoke detection apparatus including an air sampling conduit using convection air currents in a cabinet.

In passively driven air sampling conduits 20, an example of which is shown in FIG. 3, a smoke detection unit 60 is mounted in communication with, e.g., on the top of, the air sampling conduit 20. Sampled air is moved through the conduit 20 by convection air currents or other air currents established within the cabinet for the electronic equipment being cooled. Advantageously, such passive detection systems do not require moving parts to produce movement of air for smoke detection sampling purposes.

One driving force that can be used for air movement in passive detection systems is buoyancy, based on the principle of warmer air rising. A second driving force that can be used is the conservation of momentum principle by which the sum of static and dynamic incompressible gas pressures remains a constant along streamlines in a system (Bernoulli's equation). In other words, higher airflow velocity results in lower static pressures facilitating intake of sampled air into an air sampling conduit 20.

Figure 4:
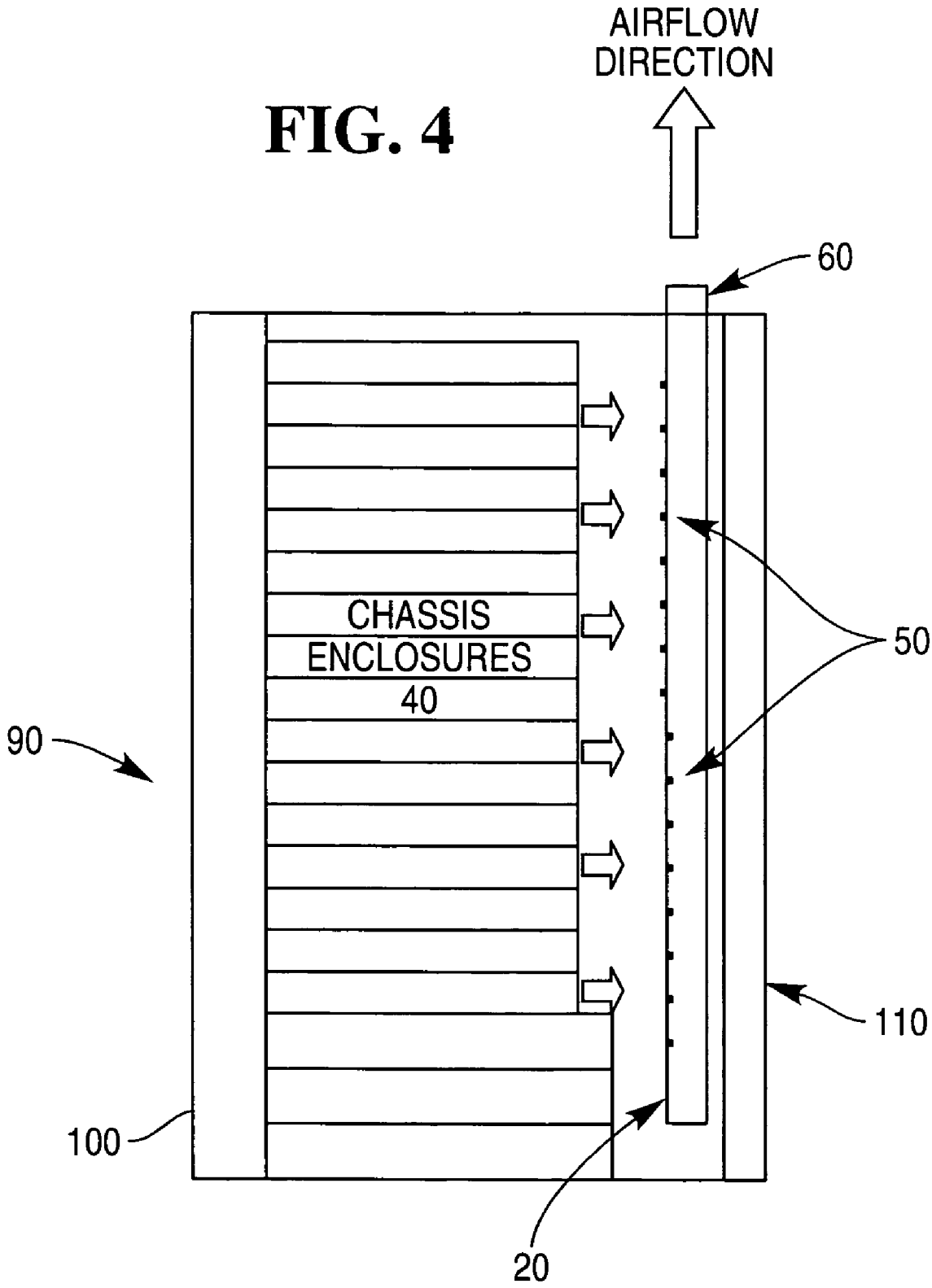
FIG. 4 shows smoke detection apparatus of FIG. 3 used in an air cooled electronic chassis cabinet shown in side view.

The air sampling conduit 20 shown in FIGS. 3 and 4 is mounted vertically, where in a passively driven system it has an open bottom end 70 near the cooler lower region of the cabinet 90 and a top end 80 near the upper warmer region of the cabinet 90 shown in FIG. 4. Warm air in the top end 80 of the conduit 20 continues rising, creating an upward airflow movement which reduces the static pressure local to the top conduit end 80. In other words there is an air movement within the conduit 20 from the bottom end 70 to the top end 80 due to what is known as the chimney effect. The airflow movement within the conduit 20 can reduce the static pressure inside the conduit 20 thus creating vacuum in the vicinity and outside of breathing holes 40 in the conduit 20's wall. The breathing holes 50 are spaced out in response to hardware configuration in the cabinet 90, and the number or size of the holes 50 are not uniform, but increase in an order moving upwards. The breathing holes 50 are thus configured such that controlled, e.g., near uniform, sampled air mass flow rates can be achieved for sampling air from different areas within the cabinet 90, e.g., as may be influenced by the effects of buoyancy and Bernoulli's equation. Further, to assist capturing exhaust air from a wider range of sources within the cabinet 90, fanned out nozzles (not shown) are used as inlets for the breathing holes 50.

Because of vacuum in the vicinity and outside of each breathing hole 50 and space available between the air sampling conduit 20 and the chassis 40's exhaust side, it is expected that exhaust air exiting exhaust vents of chassis 40 will mix well enough before samples of the mixed air are drawn into the conduit 20 through the breathing holes 50. Normal turbulence of air exhausting through chassis 40 exhaust vents would contribute to this mixing. The exhaust air mixture then rises inside the conduit 20 and passes through a smoke detector 60. Any trace of smoke as a result of a fire in a chassis 40 inside the rack or cabinet 90 is picked up and triggers appropriate power downs and alarms.

The design of the air sampling conduit 20 and breathing holes 50 on the conduit 20 impacts the quality of exhaust air sampling, and consequently the effectiveness of the associated smoke detection system 10. For a 24" hardware rack, the width of chassis enclosures 40 inside the rack is typically 19". Further, many computer chassis enclosures 40 employ designs that compartmentalize the interior; CPU and memory are often in one compartment with its own cooling fans, with a separate compartment being used for a power supply and sometimes I/O cards, similarly having its own cooling fans. In such configurations, two significantly independent exhaust air streams would leave chassis 40 exhaust vents. Even though some amount of mixing would be anticipated some distance down stream of the vents, quality of exhaust air sampling in terms of the degree of mixing and representation of all exhaust air would be a legitimate concern for smoke or fire detection, depending upon the configuration of the equipment.

Figure 5:
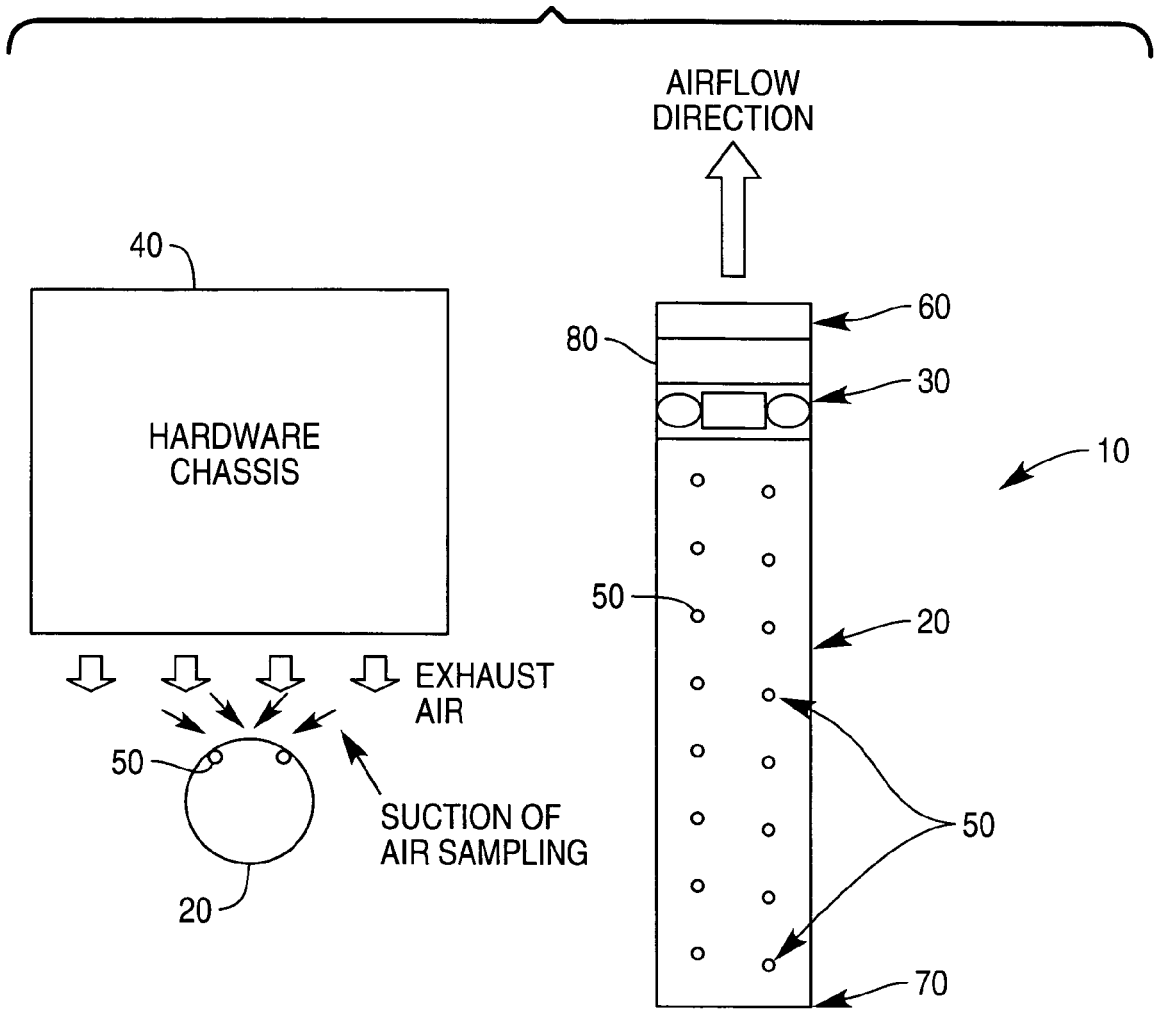
FIG. 5 shows smoke detection apparatus including an air sampling conduit with multiple rows of breathing holes.

Multiple rows of breathing holes 50 are deployed along the length of the air sampling conduit 20 to receive exhaust air from a wider range of areas as compared to a single vertical row of breathing holes 50 as shown in FIG. 5.

Figure 7:
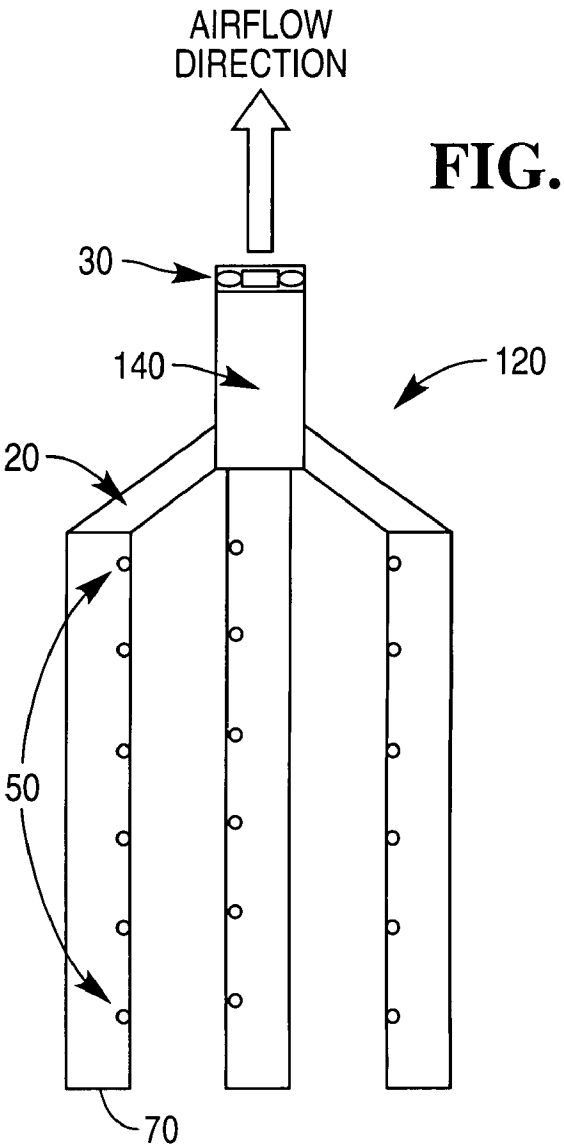
FIG. 7 shows a single fan assisted smoke detection apparatus including three air sampling conduits for wider sampling coverage.
Figure 6:
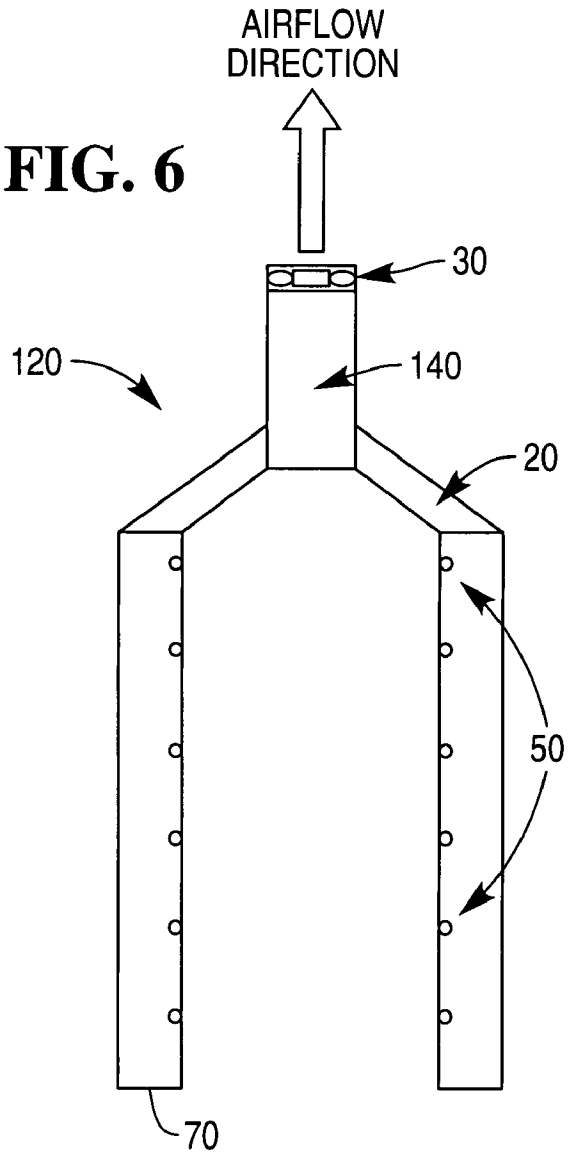
FIG. 6 shows a single fan assisted smoke detection apparatus including two air sampling conduits for wider sampling coverage.

Multi-conduit air sampling units 120 with single or multiple rows of breathing holes 50 allow exhaust air to be sampled from a wider base as shown in FIGS. 6 and 7. Each multi-conduit air sampling unit 120 comprises multiple, e.g., parallel, air sampling conduits 20 with plugged lower ends 70 and connected by a header 140 to an axial pulling fan 30 as shown in FIGS. 6 and 7.

Figure 8:
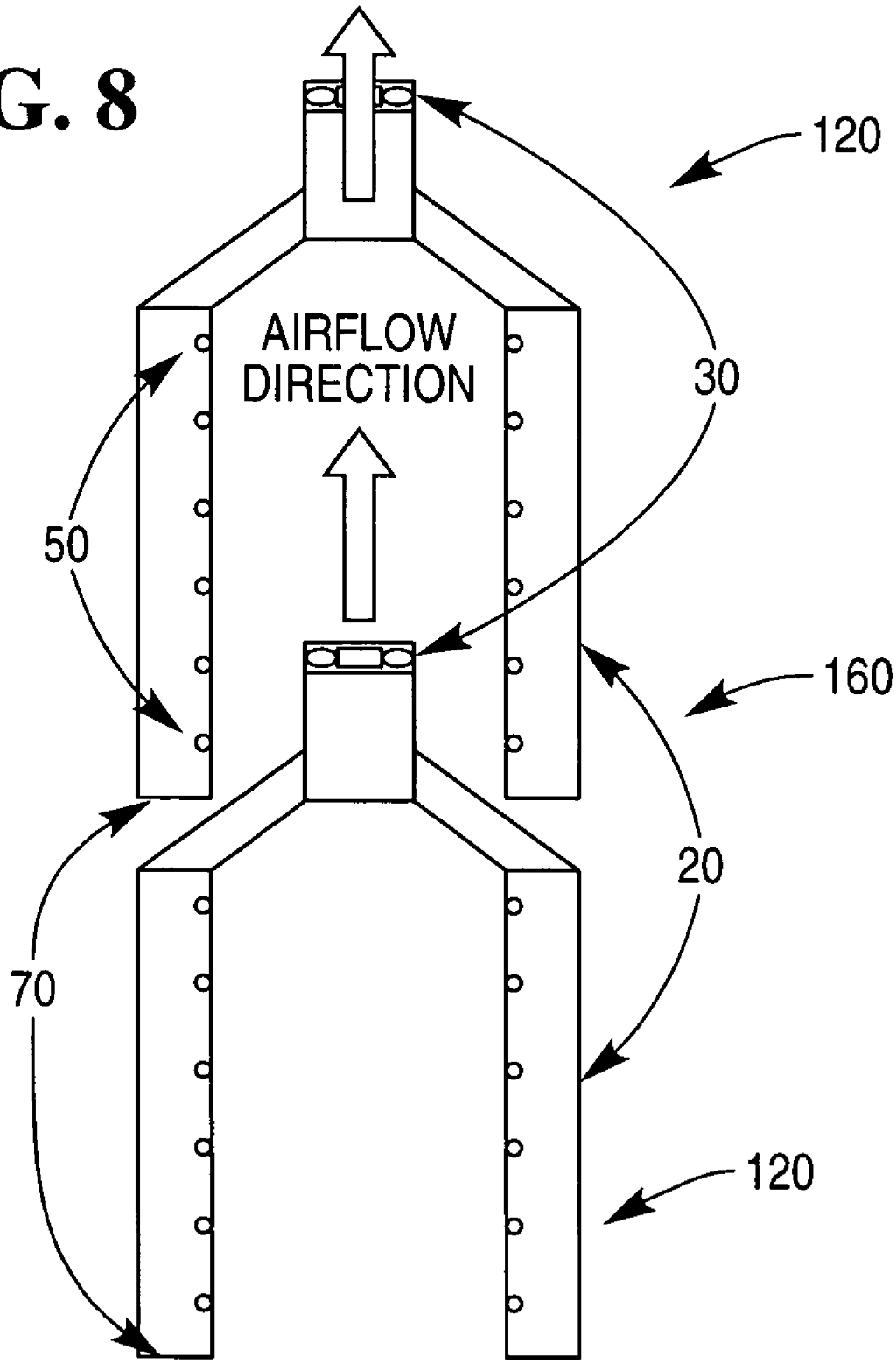
FIG. 8 shows a two stage fan assisted smoke detection apparatus including an axial fan and two air sampling conduits per stage.

Since hardware cabinets 90 often extend 6' tall and beyond, the effectiveness of air sampling conduits 20 depends upon the negative pressure within the conduits 20 (single or multiple conduits) and the vacuum outside and in the vicinity of the breathing holes 50. Pressure losses incurred by particularly long air sampling conduits 20 results in corresponding loss in negative pressure within the conduits 20. To compensate for the pressure loss, multistage conduits 160, (e.g., a stack of two or more multi-conduit air sampling units 120) are used as shown in FIG. 8.

Figure 9:
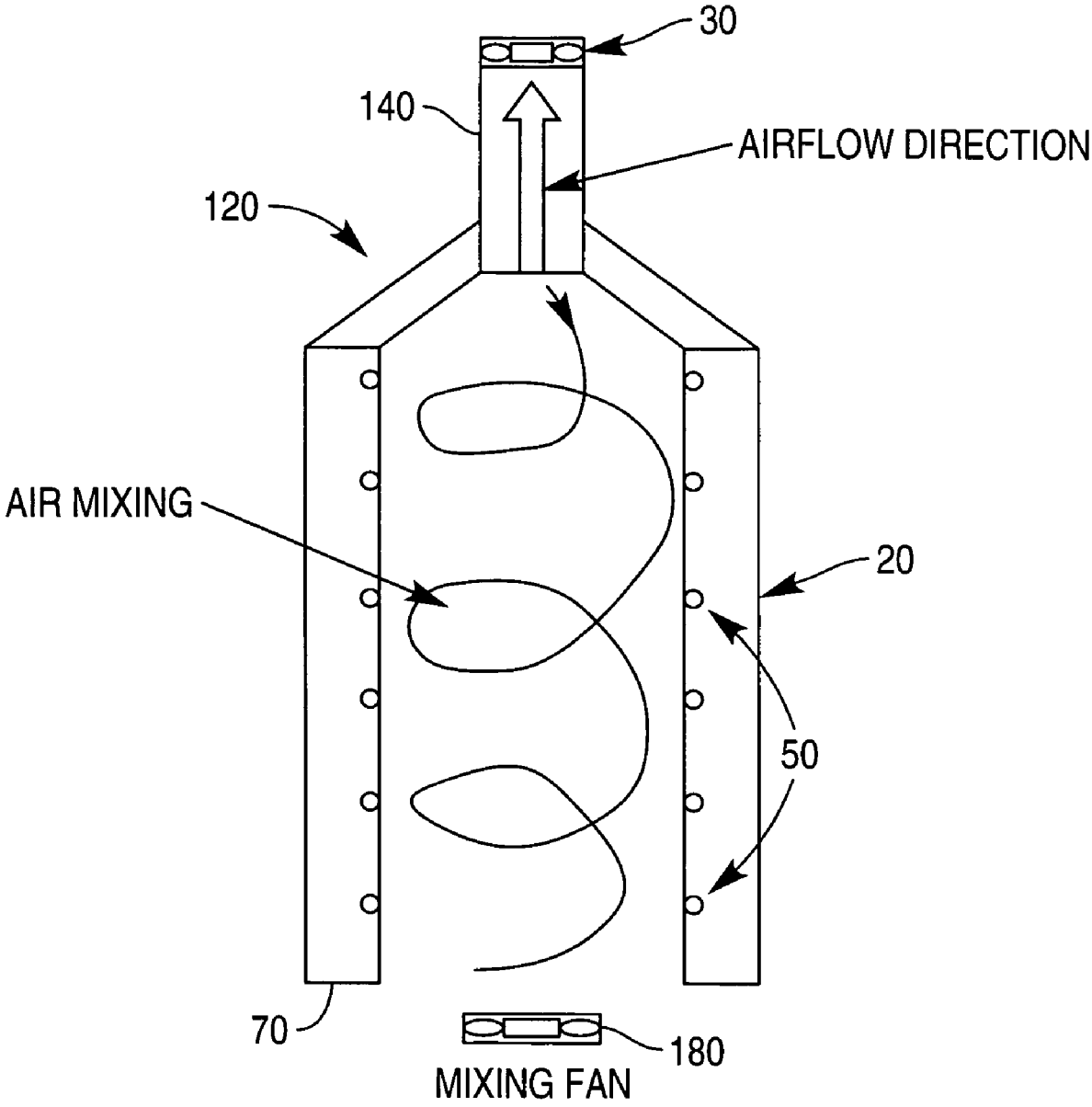
FIG. 9 shows smoke detection apparatus with an axial fan assisted pair of air sampling conduits, and an air sample mixing fan.

Yet another way of improving quality of exhaust sampling is to keep exhaust air well mixed before being drawn into the air sampling conduit 20. One or more mixing fans 180, e.g., axial fans, are used to assist exhaust air mixing. The mixing fans 180 generate air turbulence which in turn increases mixing of air from one cabinet 90 region with that from another cabinet 90 region, as shown in FIG. 9.

In order to capture exhaust air sampled from all hardware chassis 40 at all levels within a rack, the conduits 20 are configured to extend from the bottom to the top of the rack. Chassis enclosures 40 are located up against the ceiling of the rack inside an associated hardware cabinet 90. To accommodate such hardware structures, one solution is to mount the air sampling conduits 20 to the cabinet 90 frame, e.g. at the backside of the rack. However, as the backside of the rack in many cases is congested with deep chassis enclosures 40 and large numbers of cables, there will not always be much room for the conduits 20. For example, available air sampling conduit 20 mounting locations inside or against the rack may very well get into way during service when access to cables or subsystems, such as power supplies and fan modules, is necessary. Dismounting the conduits 20 before servicing inside cabinets 90 may be cumbersome or undesirable.

On the other hand, mounting the air sampling conduits 20 to the cabinet rear door 110 addresses the access or space concerns, but potentially leaves hardware chassis enclosures 40 located on the top of the rack uncovered for fire or smoke detection.

Figures 10, 11:
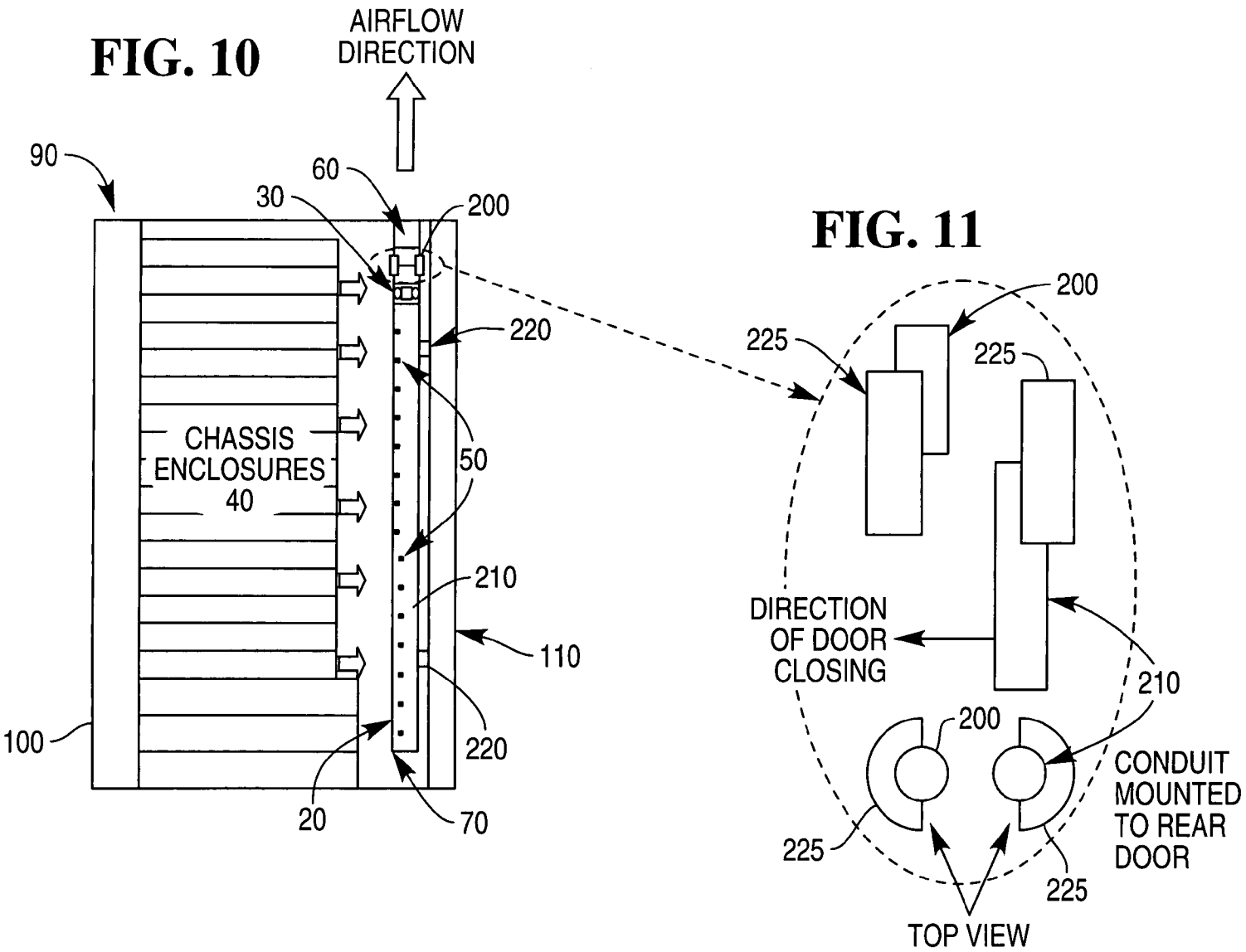
FIG. 10 shows smoke detection apparatus comprising a two section air sampling conduit in an air cooled electronic chassis cabinet.
FIG. 11 shows a two section air sampling conduit structure for smoke detection shown in FIG. 10.

A conduit coupling variation that will address both packaging density/service concerns (insufficient space in the back of cabinet 90) and exhaust sampling coverage concerns (conduits 20 extending all the way to the top of cabinet 90) is shown in FIGS. 10 and 11. As shown, a vertically running conduit 20 is provided in at least two sections, with one section 200 attached to the cabinet rear door 110 and the other section 210 inside the cabinet 90 with a coupling that connects the two sections 200 and 210 when the rear door 110 is closed. The conduit section 210 is attached to the door 110 by any appropriate bracket or mounting mechanism 220 as shown in FIG. 10, and sections 200 and 210 engage using foam pieces 225 to provide cushioning and a seal.

The conduit section or sections 210 attached to the cabinet rear door comprise a majority of the conduit 20, so that cable or equipment access during service is preserved as conduits 20 will not be obstructing access. Further, the illustrated conduit(s) 20 would extend all the way to the ceiling of the cabinet 90 thus improving full exhaust sampling coverage for an enclosed rack of chassis enclosures 40.

In order to capture exhaust air samples from all hardware chassis within the rack, it is desirable that adequate draw or suction be available within air sampling conduits 20. It is also important that the size or the diameter of the conduits 20 be sufficiently small so that the conduits 20 do not significantly impede exhaust airflow. These factors are addressed by cabinet 90 level fire detection mechanisms 10 with smaller air sampling conduits 20 and higher capacity mixing fans 180. Fans 30 pulling air through smaller diameter air sampling conduits 20 can produce substantial airflow within the conduit 20. For example, a 50 mm axial fan 30 pulling 10 CFM of air produces an airflow velocity of about 2.4 meters per second.

For conventional ionization types of smoke detector 60, the detection of smoke particles in the air stream relies on the mixing of the smoke particles with alpha particles thus reducing current flow generated by ionization of alpha particles or ions with oxygen and nitrogen atoms in the air. When the speed of the air stream which may contain smoke particles is high, the chances of smoke particles in the air stream being attached to the ions are much reduced, making smoke detection less reliable for higher speed air streams.

Figures 12, 13:
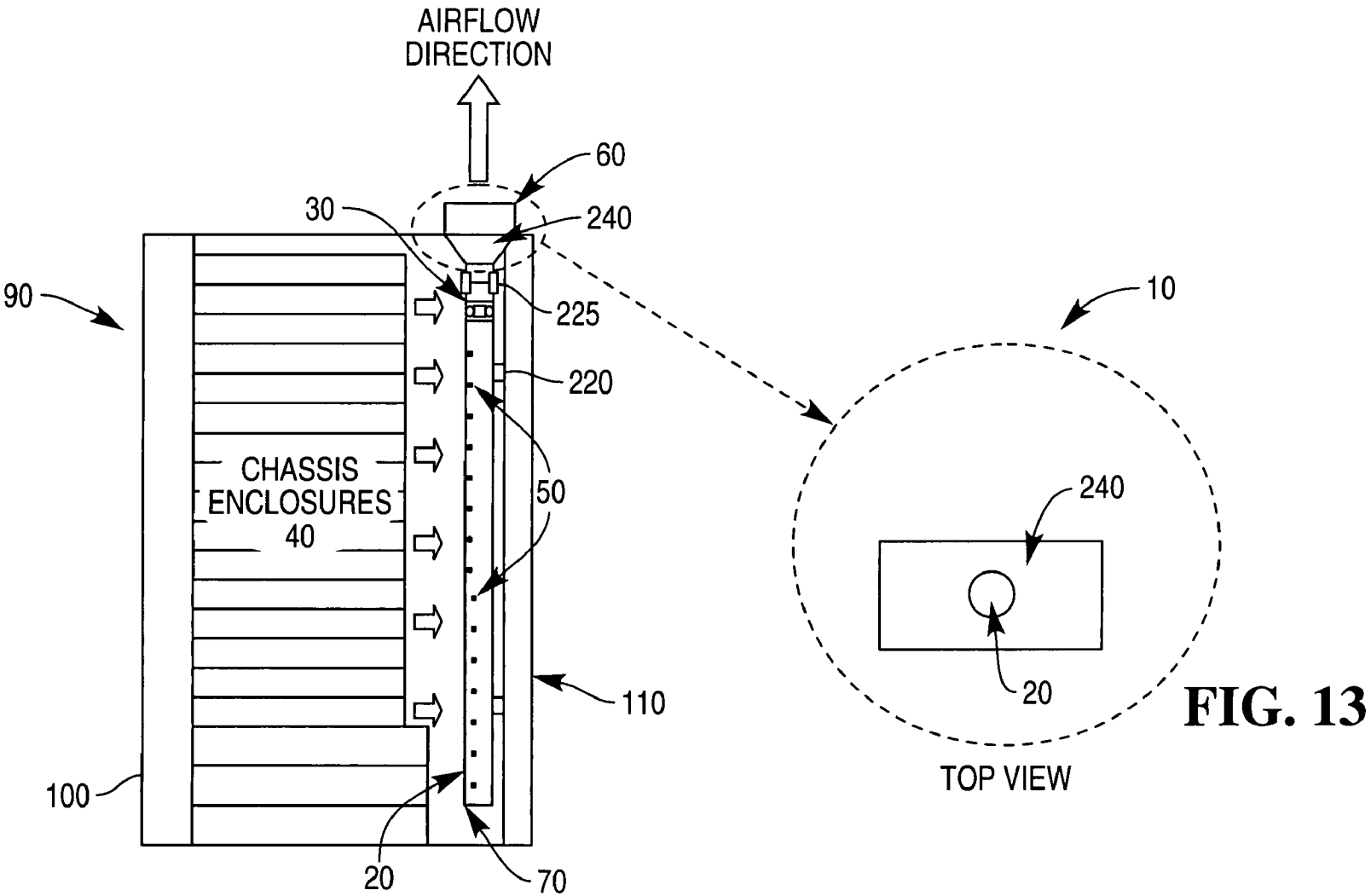
FIG. 12 shows a fan assisted smoke detection apparatus comprising an air sampling conduit with an air speed reducing expansion joint.
FIG. 13 shows an air sampling conduit and expansion joint structure shown in FIG. 12, e.g., for accommodating multiple smoke detection devices (not shown).

Instead of mounting a smoke detector 60 directly down stream on top of the pulling fan 30, an expansion joint 240 is used as shown in FIGS. 12 and 13, to couple the top end 80 of the conduit 20 or the outlet end of the fan 30 and a smoke detection chamber of expansion joint 240 whose cross sectional area is significantly bigger than that of the conduit 20. The cross section of the smoke detection chamber is sized and shaped to accommodate a smoke detector 60, or multiple smoke detectors 60, mounted within or in communication with the confines of the expansion joint 240.

The diameter of an illustrated conduit 20 is about 50 mm whereas the diameter of a household smoke detector 60 is typically about 5" or 127 mm. If one such smoke detector 60 is used, then an airflow speed reduction of approximately 6.5 ($=(127/50)^2$) or a reduction from 2.4 m/s to 0.37 m/s can result. If two smoke detectors 60 are needed to provide redundancy, then the reduction in airflow speed would be 16.5 or 0.145 m/s. The effectiveness of smoke detecting can thus be improved by reducing passing air velocity, e.g., by implementing an expansion joint 240 as illustrated in FIGS. 12 and 13.

The illustrated expansion joint 240 provides an inexpensive way of reducing the speed of the air stream down stream of an axial pulling fan 30, to improve effectiveness of ionization smoke detectors 60 in hardware cabinets 90.

Figure 15:
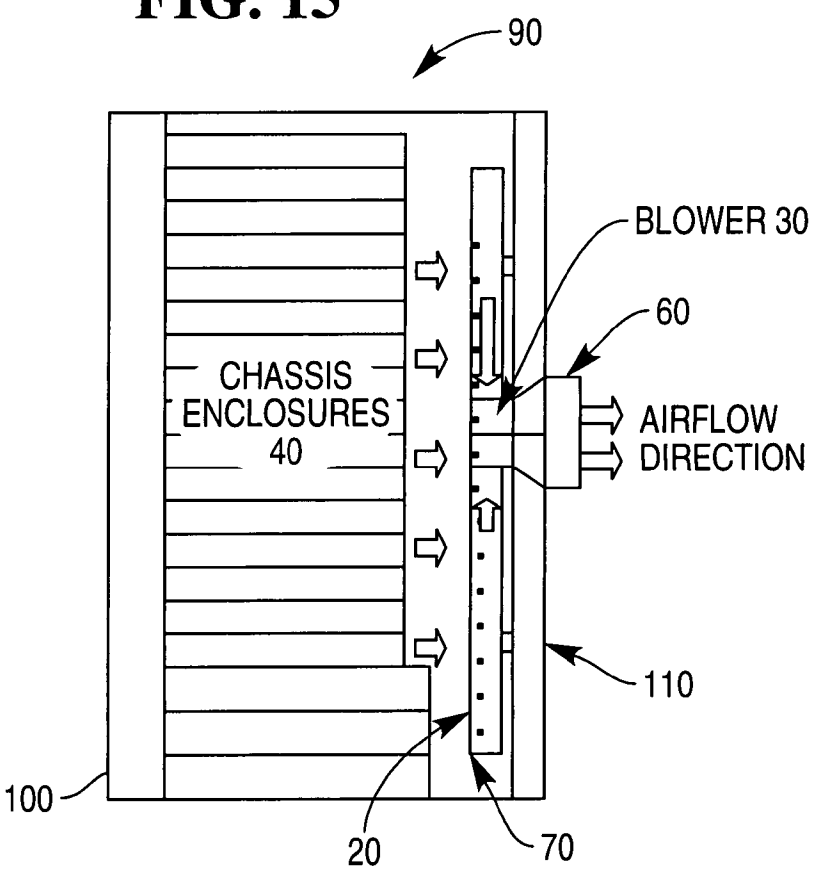
FIG. 15 shows a blower assisted smoke detection apparatus with horizontally directed exhaust from a mid section of an air sampling conduit.
Figure 14:
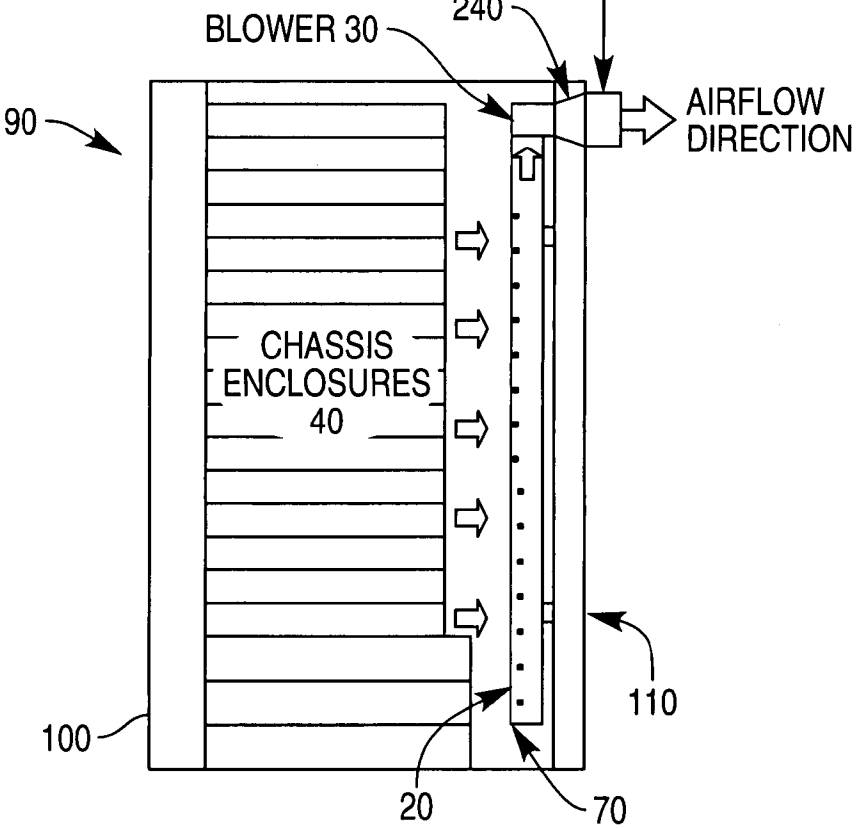
FIG. 14 shows a blower assisted smoke detection apparatus with horizontally directed exhaust from the top of an air sampling conduit.

Instead of using axial fans 30 which would normally be located at the top end 80 of the conduit 20 in order to create adequate negative pressures along the whole length of the conduit 20, a blower type fan 30 is employed as shown in FIGS. 14 and 15. While axial fans 30 generally take air in and exhaust it in the same airflow direction, the intake airflow direction of blowers 30 is generally vertical or 90 degrees in relation to the exhaust airflow direction. Use of blowers instead of axial fans allows the blower to be placed at the top of the conduit 20 as shown in FIG. 14 or along the length of the conduit 20 as in FIG. 15.

The blowers 30 as well as smoke detectors 60 are typically located somewhere in the middle of a cabinet 90 rendering shorter effective conduit 20 run lengths and improved pressure loss factors for conduits 20, as well as lower and easier service access to blowers 30 and smoke detectors 60, as shown in FIG. 15.

Two or more blowers 30 with each dedicated to a shorter air sampling conduit 20 address concerns related to inadequate negative pressures in a longer conduit 20. Such blower based configurations provide a flexible solution that can make fans and smoke detectors accessible without relying on a ladder for servicing, thus making cabinet 90 level smoke detection system 10 more serviceable without extra tools. Such designs allow flexibility in meeting pressure requirements within air sampling conduits 20 to better ensure air sampling quality for effective smoke detection in as cabinet 90.

The text above describes one or more specific embodiments or examples of a broader invention. The invention is also carried out in a wide variety of other alternative ways and is thus not limited to those described here. Many other embodiments of the invention are also within the scope of the following claims.

What is claimed is:

1. A smoke detection apparatus for use with an air cooled electronic chassis cabinet, where different electronic chassis assemblies are stacked vertically within the cabinet comprising:

an air sampling conduit having one or more orifices at each of different areas of said conduit, to sample exhaust air from an exhaust side of one or more of the different electronic chassis assemblies stacked vertically within the cabinet;

a smoke detection device coupled to said air sampling conduit, connected to detect and signal smoke drawn into said air sampling conduit though said orifices; and a fan coupled to said air sampling conduit and connected to draw exhaust air from said chassis assemblies through said orifices and into said air sampling conduit, said smoke detection device being connected to detect smoke drawn into said air sampling conduit by said fan, said exhaust air being exhausted from said cabinet.

2. The smoke detection apparatus of claim 1 in which said orifices are positioned and sized to provide substantially balanced sampled air flow rates through said orifices and into said air sampling conduit at each of said different areas, where sampled air is drawn through said orifices by pressures resulting from moving air rising in said conduit.

3. The smoke detection apparatus of claim 1 in which said air sampling conduit is open at one end, said orifices being situated between the open end of said conduit and said smoke detection device, said smoke detection device being mounted to receive sampled air drawn into said conduit by convection of air rising in said conduit.

4. The smoke detection apparatus of claim 1 in which said orifices are positioned and sized to provide substantially balanced sampled air mass flow rates through said orifices and into said air sampling conduit at each of said different areas.

5. The smoke detection apparatus of claim 1 in which said air sampling conduit is plugged at one end, and said fan is an axial fan mounted within said air sampling conduit, said orifices being situated between the plugged end of said air sampling conduit and said axial fan, and said smoke detection device being mounted to receive sampled air drawn into said air sampling conduit and exhausted by said axial fan.

6. The smoke detection apparatus of claim 1 in which said air sampling conduit is one of multiple air sampling conduits spaced to sample exhaust air across the width of said cabinet, where said conduits are coupled via a manifold to said fan.

7. The smoke detection apparatus of claim 6 further comprising a mixing fan connected to mix exhaust air prior to being sampled through said orifices.

8. The smoke detection apparatus of claim 6 in which the fan is one of multiple fans each coupled via a manifold to a different group of said conduits.

9. The smoke detection apparatus of claim 8 in which different groups of air sampling conduits are spaced to sample exhaust air from different chassis assemblies.

10. The smoke detection apparatus of claim 8 in which different groups of air sampling conduits are spaced to sample exhaust air from different sides of said cabinet.

11. The smoke detection apparatus of claim 8 in which each of said multiple fans is a blower that directs sampled exhaust air out the back of said cabinet.

12. The smoke detection apparatus of claim 1 in which said air sampling conduit comprises at least two sections, one section being adapted for attachment to a rear door of said cabinet and the other section adapted for attachment to said cabinet, so that the two sections are aligned when said door is closed and separate when said door is open, to facilitate access to said electronic chassis assemblies when said rear door is open.

13. The smoke detection apparatus of claim 1 further comprising an expansion joint coupling said fan with said smoke detection device, said expansion joint being coupled to said air sampling conduit within which said fan is mounted, and said expansion joint expanding to a cross section to accommodate said detection device.

14. The smoke detection apparatus of claim 13 in which said smoke detection device is one of multiple smoke detection devices within said expansion joint.

15. The smoke detection apparatus of claim 1 in which said fan is a blower for which the direction of output airflow is different from the direction of the input airflow.

16. The smoke detection apparatus of claim 15 in which said fan is mounted to direct sampled exhaust air out the back of said cabinet.

17. The smoke detection apparatus of claim 15 in which said fan is positioned centrally between opposite ends of said air sampling conduit.

18. An air cooled electronic chassis cabinet assembly, comprising:

two or more electronic chassis assemblies stacked vertically within said cabinet;

an air sampling conduit vertically disposed within said cabinet on a warmed air exhaust side of said electronic chassis assemblies, said conduit having one or more orifices at each of two or more different vertical levels to sample exhaust air from the exhaust side of different electronic chassis assemblies, wherein the exhaust air from the exhaust side is being exhausted from said cabinet assembly;

a fan within said conduit above said orifices, connected to draw exhaust air from said chassis assemblies through said orifices and into said conduit; and a smoke detection device connected to detect smoke drawn into said conduit by said fan.

19. A method of detecting smoke in an air-cooled electronic component cabinet comprising the steps of(1) providing an air sampling conduit enabling smoke detection from samples of air collected from outside the conduit, said conduit including orifices via which said samples of air are collected, (2) providing a fan coupled to said air sampling conduit to draw exhaust air being exhausted from said cabinet through said orifices and into said air sampling conduit and (3) providing one or more smoke detection devices mounted to detect smoke in said samples of air that enter the conduit.

20. A method of retrofitting an air-cooled electronic component cabinet for smoke detection comprising steps of (1) providing an air sampling conduit enabling smoke detection from samples of air collected from outside the conduit, said conduit including orifices via which said samples of air are collected, and (2) providing a fan coupled to said air sampling conduit to draw exhaust air being exhausted from said cabinet through said orifices and into said air sampling conduit and (3) providing one or more smoke detection devices mounted to detect smoke in said samples of air that enter the conduit.

* * * * *